US009168421B2

(12) United States Patent
Patel et al.

(10) Patent No.: US 9,168,421 B2
(45) Date of Patent: Oct. 27, 2015

(54) FALL PROTECTION DEVICE FOR USE IN CLIMBING POLES

(75) Inventors: Parul Patel, Franklin, PA (US); Michael R. Seman, Cranberry Township, PA (US); Preston L. Anderson, Cranberry, PA (US)

(73) Assignee: Honeywell International Inc., Morristown, NJ (US)

( * ) Notice: Subject to any disclaimer, the term of this patent is extended or adjusted under 35 U.S.C. 154(b) by 583 days.

(21) Appl. No.: 13/372,006

(22) Filed: Feb. 13, 2012

(65) Prior Publication Data

US 2012/0205193 A1 Aug. 16, 2012

Related U.S. Application Data

(60) Provisional application No. 61/443,068, filed on Feb. 15, 2011.

(51) Int. Cl.
*A63B 27/00* (2006.01)
*A62B 35/00* (2006.01)

(52) U.S. Cl.
CPC ..... *A63B 27/00* (2013.01); *A62B 35/0068* (2013.01)

(58) Field of Classification Search
CPC .. A61F 5/02; A62B 35/0068; A62B 35/0075; A63B 27/00; A63B 27/02; A63B 27/04
USPC ..... 5/120, 128, 129, 130
See application file for complete search history.

(56) References Cited

U.S. PATENT DOCUMENTS

| | | | | | |
|---|---|---|---|---|---|
| 1,120,496 | A | | 12/1914 | Holsclaw | |
| 2,920,714 | A | | 1/1960 | Johnson | |
| 3,088,438 | A | * | 5/1963 | Oliphant | 119/770 |
| 3,407,898 | A | | 10/1968 | Johnson | |
| 3,840,091 | A | | 10/1974 | Conlon | |
| 4,579,196 | A | | 4/1986 | Allen et al. | |
| 4,712,646 | A | | 12/1987 | Page | |
| 4,745,911 | A | * | 5/1988 | Bender | 482/139 |
| 5,090,503 | A | * | 2/1992 | Bell | 182/5 |
| 5,137,113 | A | | 8/1992 | Lortie | |
| 5,141,074 | A | | 8/1992 | Sulowski et al. | |
| 5,234,074 | A | * | 8/1993 | Bell | 182/9 |
| 6,644,438 | B1 | * | 11/2003 | Chang et al. | 182/9 |
| 6,752,242 | B1 | | 6/2004 | Whitehead et al. | |
| D604,912 | S | | 11/2009 | Paul | |
| 2010/0051382 | A1 | | 3/2010 | Schlief | |
| 2011/0214941 | A1 | * | 9/2011 | Petty et al. | 182/9 |
| 2012/0292129 | A1 | * | 11/2012 | Seman | 182/9 |

* cited by examiner

*Primary Examiner* — Colleen M Chavchavadze
(74) *Attorney, Agent, or Firm* — Wood, Phillips, Katz, Clark & Mortimer

(57) ABSTRACT

A fall protection system for use by a person in climbing a pole includes an outer strap, an outer strap connector adapted to adjust the length of the outer strap in operative connection with the outer strap, a sliding member slidably positioned on the outer strap, a cross strap attached at one end thereof to the sliding member, the cross strap being in operative connection with the outer strap connector at another end thereof, a first adjustment strap operatively attached to the outer strap connector via a first adjustment buckle at a first end thereof and attached to a first end connector at a second end thereof.

31 Claims, 7 Drawing Sheets

Fig. 5A
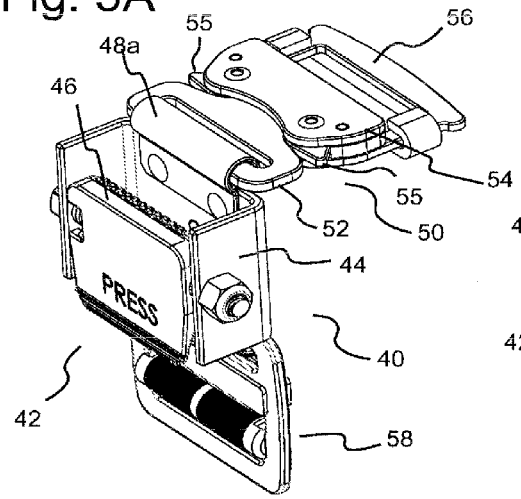
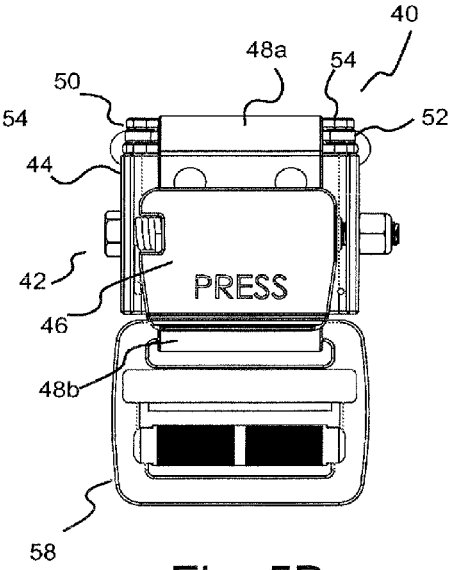
Fig. 5B
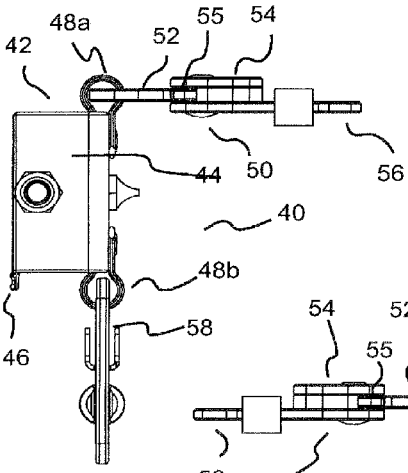
Fig. 5D
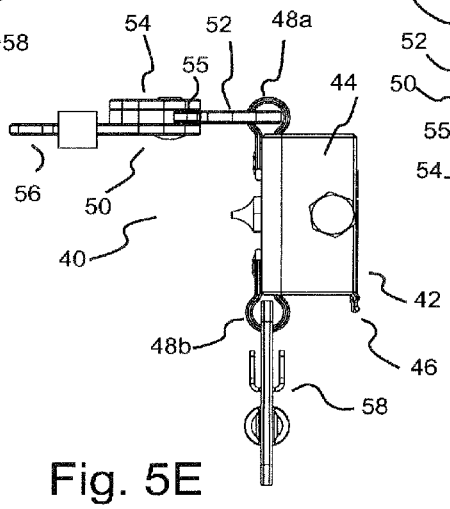
Fig. 5E
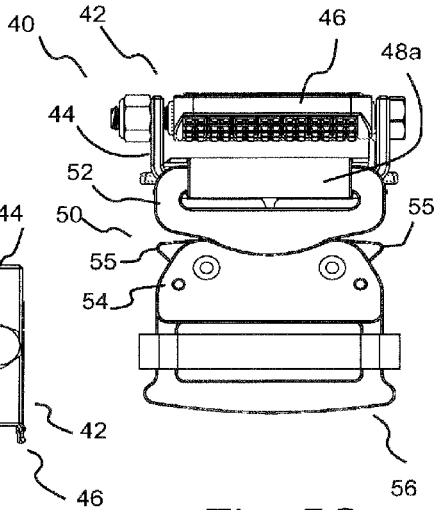
Fig. 5C

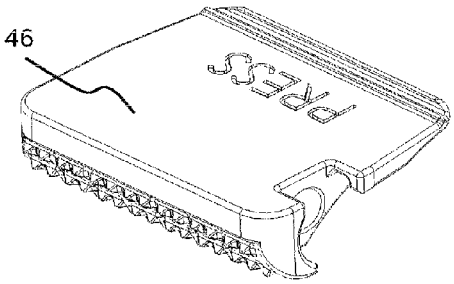
Fig. 7A
Fig. 7B
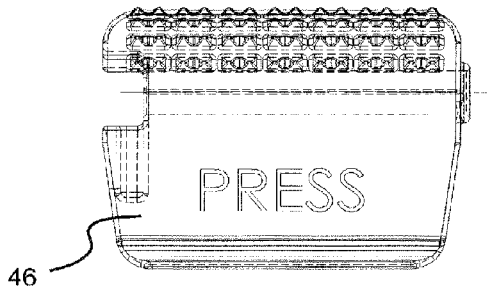
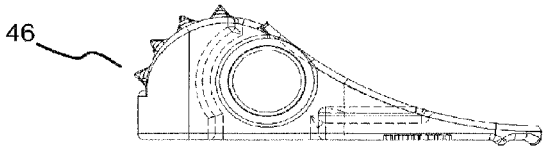
Fig. 7C
Fig. 6A
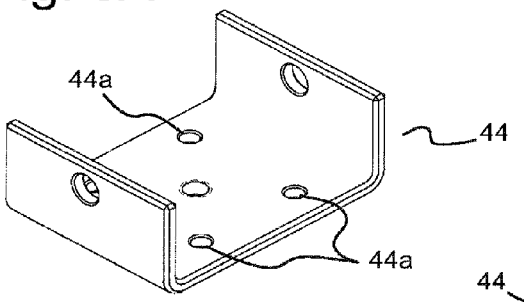
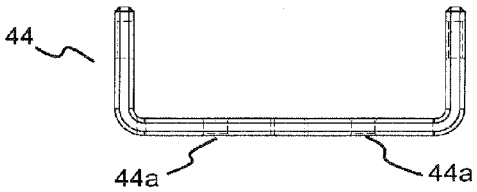
Fig. 6B
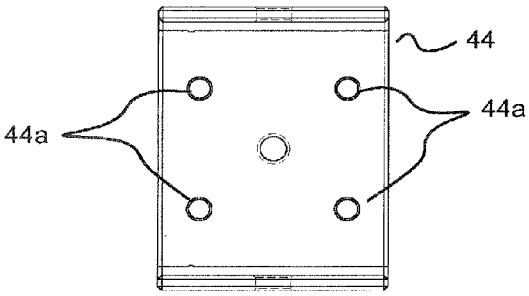
Fig. 6C

FALL PROTECTION DEVICE FOR USE IN CLIMBING POLES

CROSS-REFERENCE TO RELATED APPLICATIONS

This application claims the benefit of the filing date of U.S. Provisional Ser. No. 61/443,068, filed Feb. 15, 2011, which is hereby incorporated by reference in its entirety.

FEDERALLY SPONSORED RESEARCH OR DEVELOPMENT

Not Applicable.

MICROFICHE/COPYRIGHT REFERENCE

Not Applicable.

FELD

This application relates to fall protection devices for use in climbing poles and, more particularly, to pole straps for use in climbing poles.

BACKGROUND

The following information is provided to assist the reader to understand the technology described below and certain environments in which such technology can be used. The terms used herein are not intended to be limited to any particular narrow interpretation unless clearly stated otherwise in this document, References set forth herein may facilitate understanding of the technology or the background thereof. The disclosures of all references cited herein are incorporated by reference.

Climber of wooden structures (for example, wooden poles, trees etc.), including lineman who climb wooden power poles, often use fall protection systems including a safety strap assembly including a pole strap having two ends with a loop that can be opened to allow the user to engage and disengage the loop from the structure to be climbed. The climber pushes the pole strap up or down the pole during ascent and descent. In the case of a fall, the force of the user's body causing tightening of the loop of the pole strap around the pole to limit the length of the fall.

Pole climbing safety devices or systems are described, for example, in U.S. Pat. Nos. 869,383, 1,120,496, 1,721,517, 2,920,714, 3,407,898, 3,840,091, 4,579,196, 4,712,646, 5,137,113, 5,141,074, and 6,752,242, U.S. Design Patent No. D604,912 and Published U.S. Patent Application No. 2010/0051382.

Many such fall protection systems are cumbersome to operate. Moreover, many such fall protection systems are also quite heavy.

SUMMARY

In one aspect, a fall protection system for use by a person in climbing a pole includes an outer strap, an outer strap connector adapted to adjust the length of the outer strap in operative connection with the outer strap, a sliding member slidably positioned on the outer strap, a cross strap attached at one end thereof to the sliding member, the cross strap being in operative connection with the outer strap connector at another end thereof, a first adjustment strap operatively attached to the outer strap connector via a first adjustment buckle at a first end thereof and attached to a first end connector at a second end thereof, the first end connector being adapted to attach to an article worn by a user, wherein the first adjustment strap is operatively connected to the first adjustment buckle so that the person pulls a free end of the first adjustment strap toward the person to draw the person toward the pole, and a second adjustment strap operatively attached to the outer strap via a second adjustment buckle at a first end thereof and attached to a second end connector at a second end thereof, the second end connector being adapted to attach to an article worn by a user, wherein the second adjustment strap is operatively connected to the second adjustment buckle so that the person pulls a free end of the second adjustment strap toward the person to draw the person toward the pole.

In a number of embodiments, the outer strap connector of the fall protection systems hereof is a cam buckle. The cross strap may, for example, be connected to the outer strap connector via a releasable buckle. In a number of embodiments, the releasable buckle includes a male member releasably connectible to a female member. The releasable buckle may, for example, be a stablock buckle.

In a number of embodiments, the fall protection system further includes a tensile member connected at a first end to the outer strap and connected at a second end thereof to the sliding member. The tensile member may, for example, include a coil spring.

At least a portion of the coil spring or other tensile member may, for example, pass through a sleeve attached to the outer strap. The sleeve may, for example, be openable to allow inspection of the coil spring or other tensile member. In a number of embodiments, the sleeve includes a zipper.

In another aspect, a fall protection system for use by a person in climbing a pole includes an outer strap, an outer strap connector adapted to adjust the length of the outer strap in operative connection with the outer strap, a sliding member slidably positioned on the outer strap, a cross strap attached at one end thereof to the sliding member, the cross strap being in operative connection with the outer strap connector at another end thereof, a tensile member connected at a first end to the outer strap and connected at a second end thereof to the sliding member, the tensile member extending only a portion of the length between the sliding member and the outer strap connector, a first adjustment strap operatively attached to the outer strap connector via a first adjustment buckle at a first end thereof and attached to a first end connector at a second end thereof, the first end connector being adapted to attach to an article worn by a user, and a second adjustment strap operatively attached to the outer strap via a second adjustment buckle at a first end thereof and attached to a second end connector at a second end thereof, the second end connector being adapted to attach to an article worn by a user.

In another aspect, fall protection system for use by a person in climbing a pole includes an outer strap, an outer strap connector adapted to adjust the length of the outer strap in operative connection with the outer strap, a sliding member slidably positioned on the outer strap, the sliding member comprising a single gaff extending therefrom, a cross strap attached at one end thereof to the sliding member, the cross strap being in operative connection with the outer strap connector at another end thereof, a first adjustment strap operatively attached to the outer strap connector via a first adjustment buckle at a first end thereof and attached to a first end connector at a second end thereof, the first end connector being adapted to attach to an article worn by a user, and a second adjustment strap operatively attached to the outer strap via a second adjustment buckle at a first end thereof and attached to a second end connector at a second end thereof, the second end connector being adapted to attach to an article worn by a user.

In another aspect, fall protection system for use by a person in climbing a pole includes an outer strap, an outer strap connector adapted to adjust the length of the outer strap in operative connection with the outer strap, a sliding member slidably positioned on the outer strap, a cross strap attached at one end thereof to the sliding member, the cross strap being in operative connection with the outer strap connector at another end thereof via an adjustment buckle wherein the person pulls a free end of the cross strap toward the person to tighten a closed loop formed by the outer strap and the cross strap around the pole, a first adjustment strap operatively attached to the outer strap connector via a first adjustment buckle at a first end thereof and attached to a first end connector at a second end thereof, the first end connector being adapted to attach to an article worn by a user, and a second adjustment strap operatively attached to the outer strap via a second adjustment buckle at a first end thereof and attached to a second end connector at a second end thereof, the second end connector being adapted to attach to an article worn by a user.

In another aspect, a fall protection system for use by a person in climbing a pole includes an outer strap, an outer strap connector adapted to adjust the length of the outer strap in operative connection with the outer strap, a sliding member slidably positioned on the outer strap, a cross strap attached at one end thereof to the sliding member, the cross strap being in operative connection with the outer strap connector at another end thereof, a tensile member connected at a first end to the outer strap and connected at a second end thereof to the sliding member, a sleeve attached to the outer strap, at least a portion of the tensile member passing through the sleeve, the sleeve being openable to allow inspection of the tensile member, a first adjustment strap operatively attached to the outer strap connector via a first adjustment buckle at a first end thereof and attached to a first end connector at a second end thereof, the first end connector being adapted to attach to an article worn by a user, and a second adjustment strap operatively attached to the outer strap via a second adjustment buckle at a first end thereof and attached to a second end connector at a second end thereof, the second end connector being adapted to attach to an article worn by a user. The sleeve may, for example, include a zipper, In a further aspect, fall protection system for use by a person in climbing a pole includes an outer strap, an outer strap connector comprising a cam buckle adapted to adjust the length of the outer strap in operative connection with the outer strap, a sliding member slidably positioned on the outer strap, a cross strap attached at one end thereof to the sliding member, the cross strap being in operative connection with the outer strap connector at another end thereof, a tensile member connected at a first end to the outer strap and connected at a second end thereof to the sliding member, a first adjustment strap operatively attached to the cam buckle via a first adjustment buckle at a first end thereof and attached to a first end connector at a second end thereof, the first end connector being adapted to attach to an article worn by a user, and a second adjustment strap operatively attached to the outer strap via a second adjustment buckle at a first end thereof and attached to a second end connector at a second end thereof, the second end connector being adapted to attach to an article worn by a user.

The cross strap may, for example, be connected to the cam buckle via a releasable buckle. The releasable buckle may, for example, include a male member releasably connectible to a female member. In a number of embodiments, the releasable buckle is a stablock buckle.

In a number of embodiments, the releasable buckle is attached to a base member of the cam buckle. The first adjustment buckle may, for example, be attached to a base member of the cam buckle.

In a number of embodiments, the tensile member includes a coil spring. At least a portion of the coil spring may, for example, pass through a sleeve attached to the outer strap. The sleeve may, for example, be openable to allow inspection of the coil spring.

In a number of embodiments, the fall protection system further includes an adjustment buckle attached to the releasable buckle to adjust a length of the cross strap extending between the sliding member and the releasable buckle.

In still a further aspect, a method of providing a fall protection system for use by a person climbing a pole, wherein the fall protection system includes an outer strap, an outer strap connector adapted to adjust the length of the outer strap in operative connection with the outer strap, a sliding member slidably positioned on the outer strap, and a cross strap attached at one end thereof to the sliding member, the cross strap being in operative connection with the outer strap connector at another end thereof, includes providing the outer strap having a length sufficient to pass around a variety of poles of various sizes, and having the user cut the outer strap to a user determined length. In a number of embodiments, the method further includes providing an abutment member and having the user attach the abutment member to the outer strap after cutting the outer strap to prevent the strap from disconnecting from the outer strap connector.

The technology described herein, along with the attributes and attendant advantages thereof, will best be appreciated and understood in view of the following detailed description taken in conjunction with the accompanying drawings.

Other features and advantages will become apparent from a review of the entire specification, including the appended claims and drawings.

BRIEF DESCRIPTION OF THE DRAWINGS

FIG. 5A illustrates a perspective view of an embodiment of a connector system for use in a fall protection system such as the fall protection system of FIG. 1;

FIG. 5B illustrates a side view of the connector system of FIG. 5A;

FIG. 5C illustrates a front view of the connector system of FIG. 5A;

FIG. 5D illustrates a top view of the connector system of FIG. 5A;

FIG. 5E illustrates a bottom view of the connector system of FIG. 5A;

FIG. 6A illustrates a perspective view of an embodiment of a base member of the connector system of FIG. 5A;

FIG. 6B illustrates a top view of the base member of FIG. 6A;

FIG. 6C illustrates a side view of the base member of FIG. 6A;

FIG. 7A illustrates a perspective view of an embodiment of a cam member of the connector system of FIG. 6A;

FIG. 7B illustrates a side view of the cam member of FIG. 7A;

FIG. 7C illustrates a top view of the cam member of FIG. 7A;

DETAILED DESCRIPTION

As used herein and in the appended claims, the singular forms "a," "an", and "the" include plural references unless the content clearly dictates otherwise. Thus, for example, reference to "a strap" includes a plurality of such straps and equivalents thereof known to those skilled in the art, and so forth, and reference to "the strap" is a reference to one or more such straps and equivalents thereof known to those skilled in the art, and so forth.

Figure 1A:
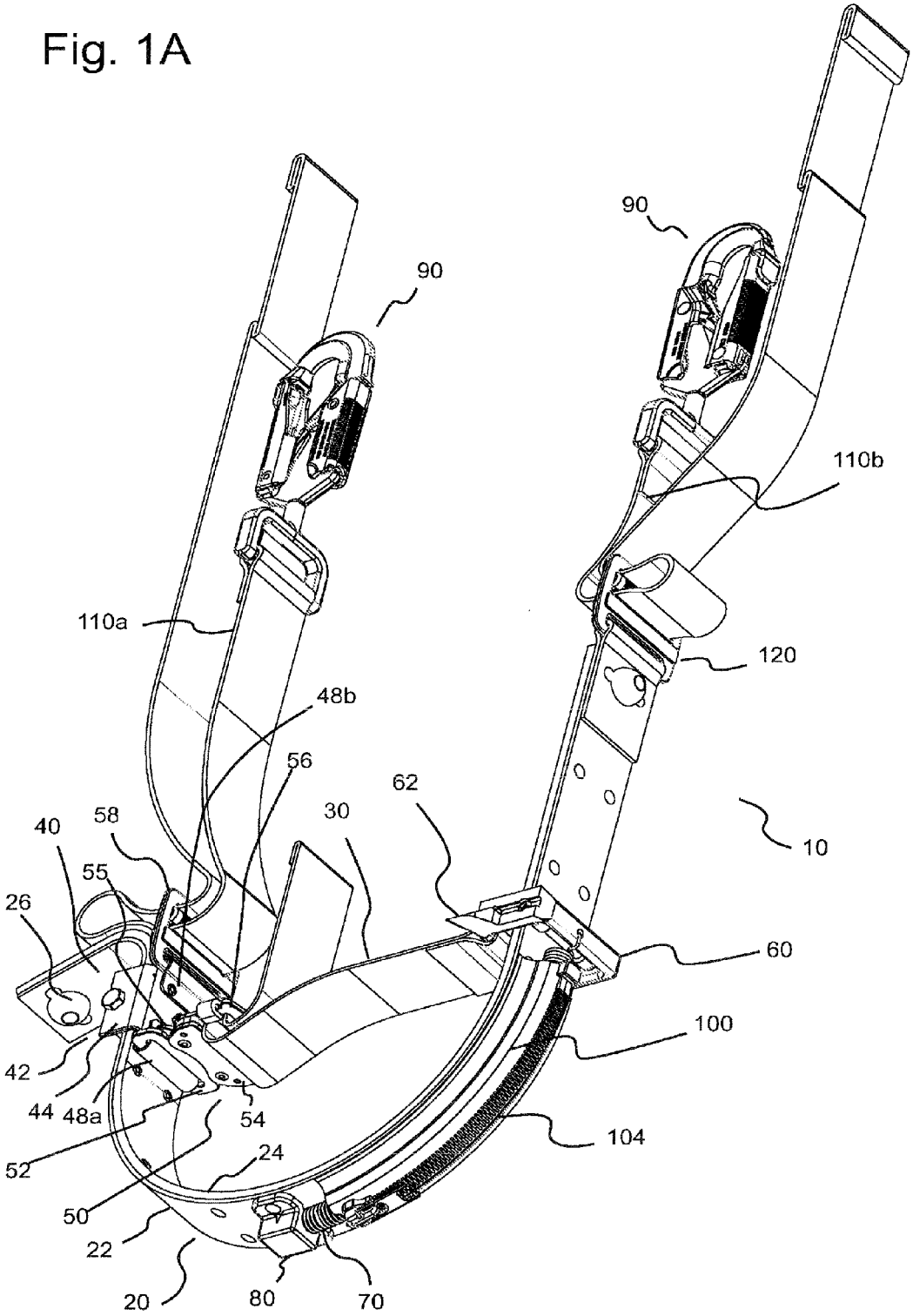
FIG. 1A illustrates a perspective view of one embodiment of a fall protection system.
Figure 1B:
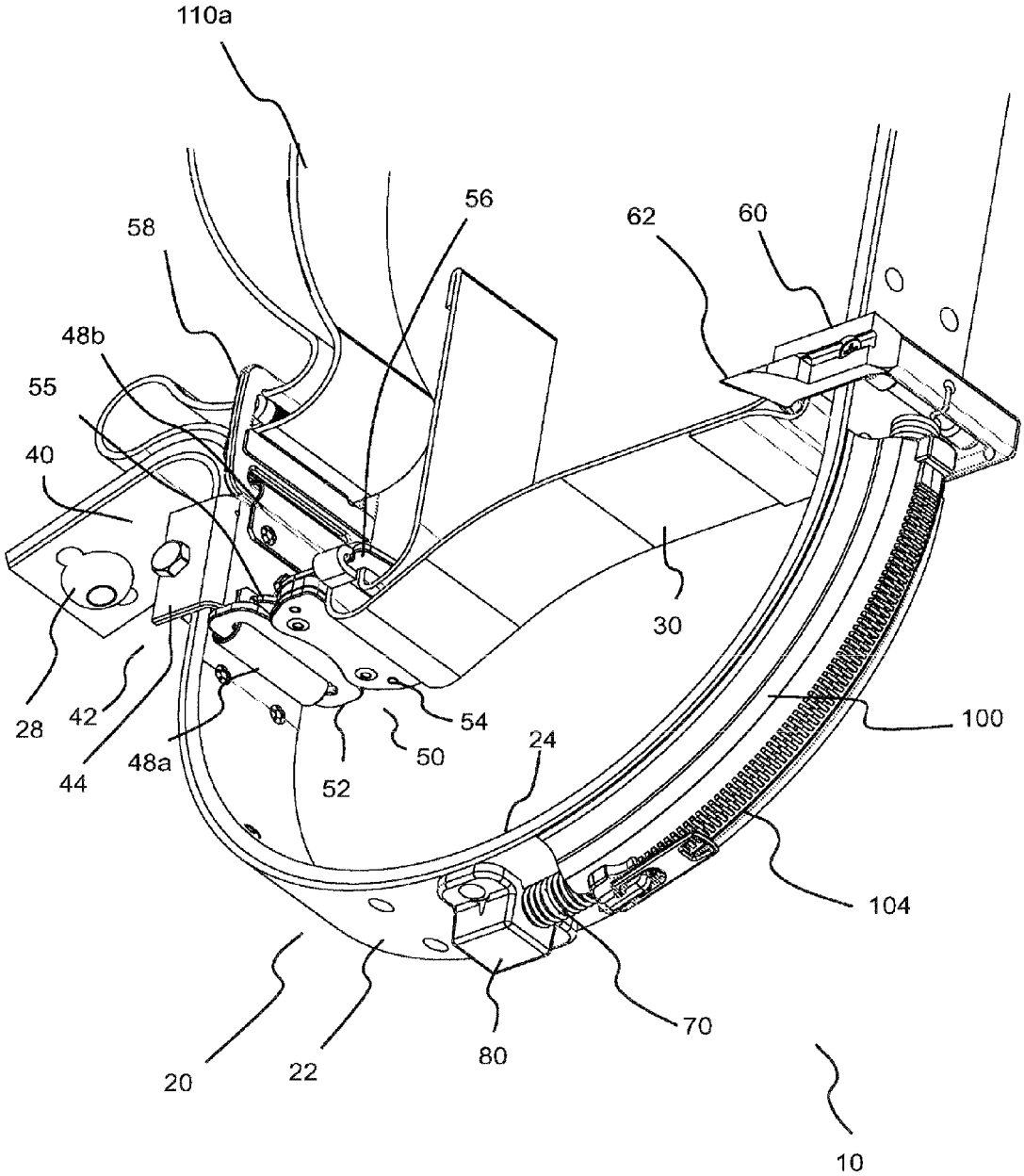
FIG. 1B illustrates an enlarged perspective view of a closed loop portion of the fall protection system of FIG. 1A.
Figure 2:
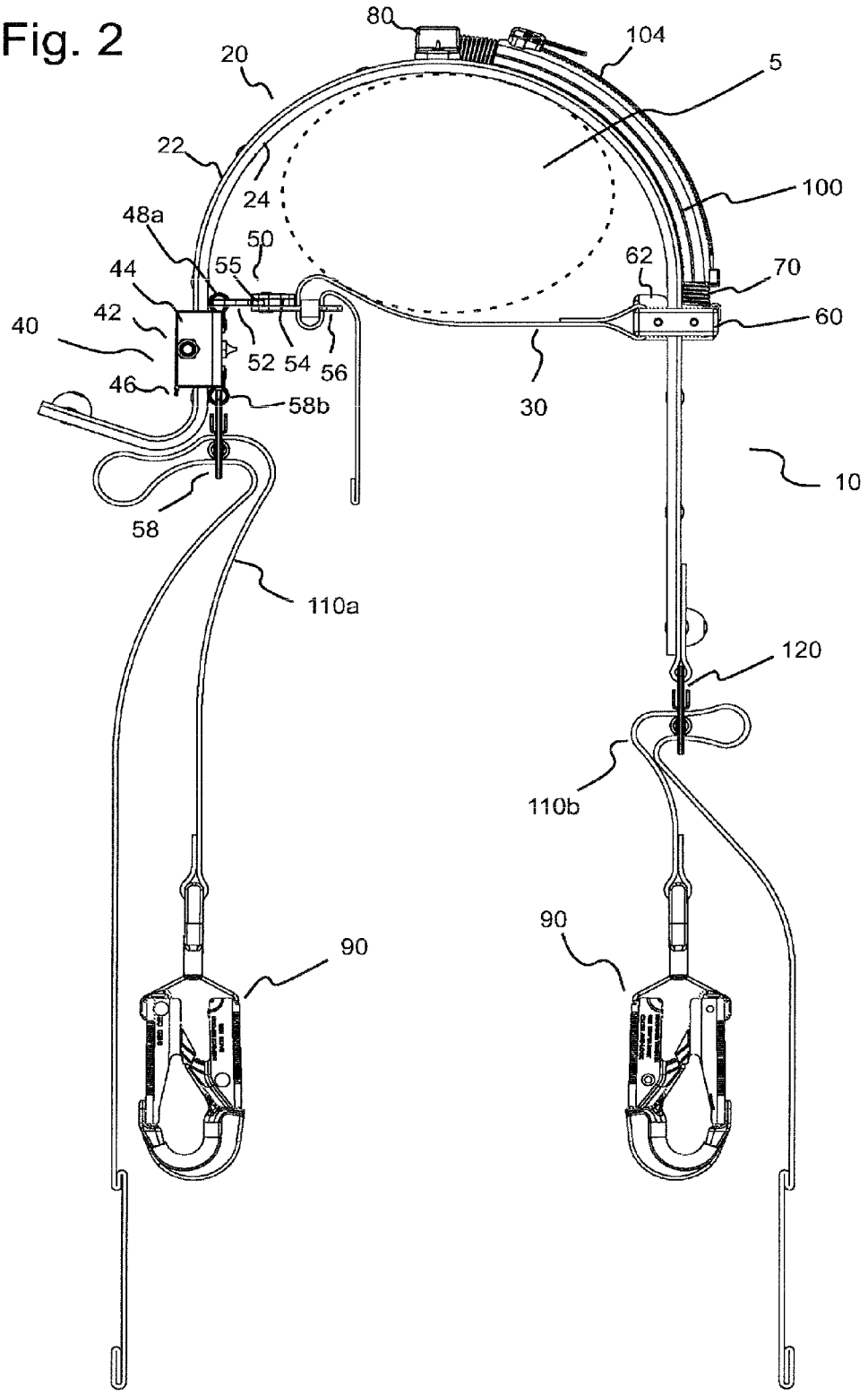
FIG. 2 illustrates a top view of the fall protection system of FIG. 1 in which the closed loop portion of the fall protection system is loosely encompassing a pole (shown in dashed lines)
Figure 3:
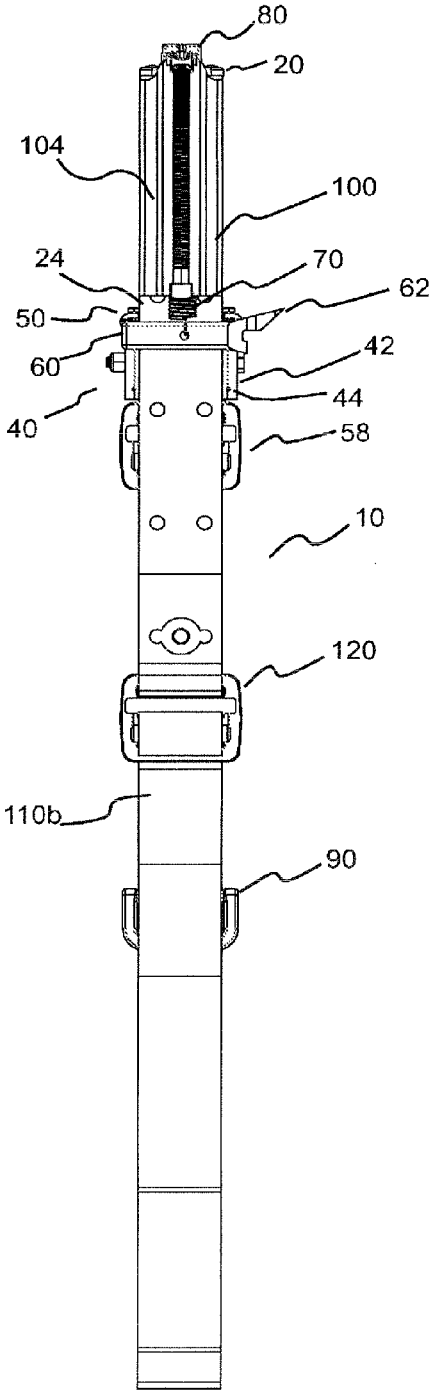
FIG. 3 illustrates a side view of the fall protection system of FIG. 1.
Figure 4:
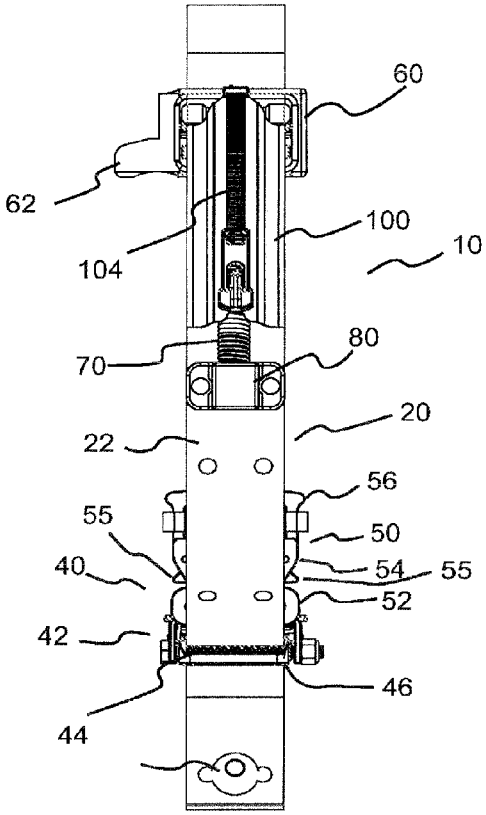
FIG. 4 illustrates a front view of the fall protection system of FIG. 1.
Figure 8A:
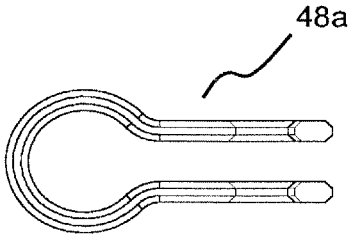
FIG. 8A illustrates an embodiment of a loop connector of the connector system of FIG. 6A.
Figure 8B:
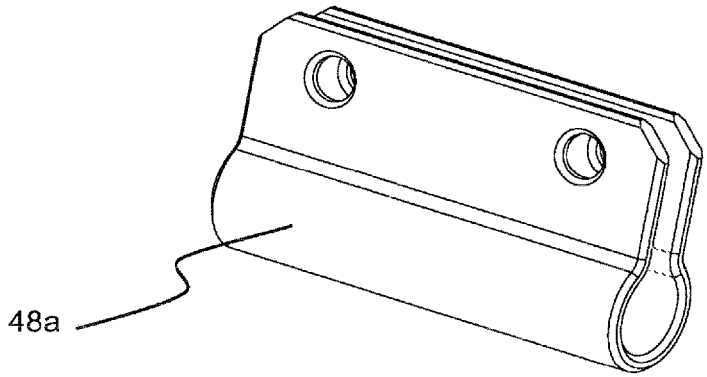
FIG. 8B illustrates a perspective view of the loop connector of FIG. 8A.

FIG. 1 through 4 illustrate an embodiment of a fall protection assembly or system 10 hereof that can, for example, be used by a lineman or other user required to climb or be suspended upon a pole or other extending structure. As used herein, the term "climb" refers generally to any type of user interaction with a pole in which a user is positioned or suspended at a height on the pole. As used herein, the term "poles" refer to extending structures of various cross-sectional shapes. Often such poles will be wooden poles. Fall protection system 10 includes an outer strap 20 and a cross strap 30 which define a closed loop which encircles a pole 5 (see FIG. 2) such as a utility pole. In the illustrated embodiment, cross strap 30 is connected at a first end thereof to a connector system 40 and at a second end thereof to a sliding member 60. Sliding member 60 is movably, floatably or slidably mounted on the outer strap 20, thus defining an intermediate portion of the outer strap 20 extending between sliding member 60 and connector system 40. Sliding member 60 is connected to a biasing tensile member 70 at one end of biasing tensile member 70. Another end of tensile member 70 is fixed to outer strap 10 via a connector 80. Tension in tensile member 70 acts to pull sliding member 60 along outer strap 10 to draw cross strap 30 into tight frictional engagement with the near side (with respect to the position of the user) of pole 5.

Outer strap 20 is a pole strap which can, for example, be a high-strength, flexible material, such as synthetic fiber or leather. Outer strap 20 is adapted to extend around the far side (with respect to the position of the user) of pole 5 when in use. Outer strap 20 is operatively connected to connectors such as snap hooks 90 which can, for example, be attached to rings or other connectors provided on an article worn upon the users' body such as a belt or a harness (not shown). In a number of embodiments, outer strap 20 was formed in at least two layers to include an outer strap layer 22 formed from a material such as neoprene and an inner strap layer 24 formed from a material such as neoprene which frictionally engages pole 5 when pulled against it. In a number of embodiments, outer strap 20 included four layers of neoprene. The neoprene or other material can, for example, be impregnated with a read wear indicators as set forth in ASTM F887. Straps, connectors, buckles etc. of fall protection system can, for example, exhibit an ultimate tensile load of 5000 pounds as set forth in CSA Z259.12 and ANSI Z359.1.

Biasing elastic tensile member 70, can, for example, include a coil spring in several embodiments. However, any biasing or elastic member providing suitable tensile force can be used as known to those skilled in the tensile member and biasing arts. For example, an elastomeric polymeric member can be used as tensile member 70. In the illustrated embodiment, tensile member 70 is held adjacent to outer strap 20 of at least a portion of the length thereof by an extending sleeve 100 that is attached to outer strap at the sides of sleeve 100. Sleeve 100 is formed of a flexible material which can, for example be stitched onto outer strap 20. In a number of embodiments, sleeve 100 is openable on an outer or far side thereof to provide for ready inspection of tensile member 70. In the illustrated embodiment, outer sleeve is openable via a zipper 104. Zipper 104 can, for example, be formed of an electrical insulating material such as a polymer (for example, a nylon material) in the case that fall protection system 10 is to be used in the vicinity of electrical transmission lines or other electrical systems. Sleeve 100 provides protective covering for biasing or elastic tensile member 70 while allowing ready access thereto for inspection (for example, after a fall situation or scenario or as part of a periodic inspection schedule).

Unlike a number of currently available fall protection systems for climbing poles, fall protection system 10 includes a single sliding member 60 in operative connection with a single tensile member 70. Tensile member 70 extends over only a portion of or over one side of the intermediate portion of outer strap 20. Once again, the intermediate portion is that portion of outer strap 20 extending between connector system 40 and sliding member 60 to define a closed loop to encompass a pole. A significant length of outer strap 20 is thereby provided through which outer strap 20 can readily be cut from connection with pole 5 in the case of an emergency rescue of a user (for example, after a fall situation in which fall protection system 10 activates to limit the distance of the fall).

In the illustrated embodiment, tensile member 70 passes through sleeve 100 to extend around the intermediate portion of the outer strap along its outer surface 22 between connector 80 and slidable member 60. As described above, tensile member 70 operates to pull slidable member 60 toward connector 80, thereby pulling cross strap 30 against the pole 5. During a normal ascent and descent of pole 5 the user can manually grasp slide members 60 (or a member attached thereto such as cross strap 30 or another member) and hold cross strap 30 away from pole 5 by extending tensile member 70. When slide member 60 is released - for example, when the user reaches a working position, or in the event that the user loses his or her footing while ascending or descending—the closed loop formed by cross strap 30 and outer strap 20 is closed into tight frictional engagement with pole 5.

In the illustrated embodiment, sliding member 60 includes a single-toothed gaff 62 extending from sliding member 60. When the closed loop formed by cross strap 30 and outer strap 20 is closed into tight frictional engagement with pole 5 as describe above, gaff 62 is pulled into biting engagement with pole 5. It was found that a single gaff 62 extending from, for example, an inner, bottom portion of sliding member 60 was suitable to provide biting engagement with pole 5. Providing only a single gaff 62 reduces weight as compared to currently available fall protection system for climbing poles, which include multiple extending gaffs.

In the illustrated embodiment, connector system 40 includes a cam buckle 42 including a generally U-shaped base member 44 to which a biased cam locking member 46 is pivotably attached to form a locking connection with a first end portion of outer strap 20. A torsion spring or other biasing member (not shown) can, for example, be used to bias cam locking member to pivot in a direction to contact outer strap 20. In a number of embodiments, fall protection system 100 is provided with outer strap 20 having a length that is suitable for attachment to the largest of poles. The end user can, for example, cut outer member 20 to a desire length and attach a stop or abutment member 26 thereto (for example, via a riveting or other process) to prevent outer strap 20 from being disconnected from cam buckle 42. Stop or abutment member 26 may, for example, be provided by the manufacturer.

Outer strap 20 may, for example, be provided with one or more markings or indications providing one or more cuttings position to adapt fall protection system 10 to poles of various sizes.

At a first end of base member 44, a bracket or loop connector 48*a* is attached via, for example, passages 44a and cooperating connectors (for example, rivets or similar connectors) to base member 44 to, for example, pivotably connect a quick connect buckle 50. Quick connect buckle 50 can, for example, be a stab-lock buckle including a male member 52 and a female member 54. As known in the buckle arts, female member 54 includes one or more biased or spring-loaded connectors with form a releasable connection with male member 52 upon insertion of a portion of male member 52 into female member 54. Release members 55 can, for example, be compresses inward or toward each other to enable release of male member 52 from female member 54 and opening of the closed loop formed by outer strap 20 and cross strap 30. Buckle 50 provides for ready fastening and unfastening of cross strap 20 to enable the user to engage fall protection system 10 with pole 5 and disengage fall protection system 10 therefrom. Female member 54 includes or has attached thereto an adjusting buckle 56 including, for example, a pair of slots through which the free end portion (that is, that end portion not connected to sliding member 60) of cross strap 20 extends to provide for ready adjustment of the length of cross strap 20. The free end portion of cross strap 30 can, for example, pass through adjustment buckle 56 so the pulling the free end portion of cross strap 30 toward the user tightens the closed loop formed by outer strap 20 and cross strap 30.

At a second end of buckle member 42, another bracket or loop connector 48*b* (which can, for example, be identical to loop connector 48*a*) is attached via, for example, passages 44*a* and cooperating connectors to base member 44 to, for example, pivotably connect an adjustment buckle 58 to base member 44. Adjustment buckle 58 can, for example, include a pair of slots through which a strap 110*a*, to which one of snap hooks 90 is attached, passes for adjustment of the length thereof (and thereby the distance of the user from pole 5). In a number of embodiments, strap 110*a* passes through adjustment buckle 58 so that adjustment of strap 110*a* via adjustment buckle 58 to bring the user closer to the pole requires the user to pull the free end of strap 110*a* (that is, the end to which snap hook 90 is not connected) toward the user. In currently available fall protection systems for climbing poles, adjustment of straps to draw the user closer to the pole typically requires the user to pull straps in a direction away from the user, which is cumbersome.

A second end portion of outer strap 20, which passes through sliding member 60, is attached to an adjustment buckle 120 that is similar to or the same as adjustment buckle 58. Adjustment buckle 120 can, for example, include a pair of slots through which a strap 110*b*, to which the other of snap hooks 90 is attached, passes for adjustment of the length thereof (and thereby the distance of the user from pole 5). As described above, strap 110*b* can pass through adjustment buckle 120 so that adjustment of strap 110*b* via adjustment buckle 120 to bring the user closer to the pole requires the user to pull the free end of strap 110*b* (that is, the end to which snap hook 90 is not connected) toward the user.

The foregoing description and accompanying drawings set forth a number of representative embodiments at the present time. Various modifications, additions and alternative designs will, of course, become apparent to those skilled in the art in light of the foregoing teachings without departing from the scope hereof, which is indicated by the following claims rather than by the foregoing description. All changes and variations that fall within the meaning and range of equivalency of the claims are to be embraced within their scope.

The invention claimed is:

1. A fall protection system for use by a person in climbing a pole, comprising:

an outer strap;

an outer strap connector in operative connection with the outer strap and adapted to adjust a length of the outer strap to extend around a pole;

a sliding member slidably positioned on the outer strap, a cross strap attached to the sliding member at one end of the cross strap, the cross strap being in operative connection with the outer strap connector at another end of the cross strap, a first adjustment strap operatively attached to the outer strap connector via a first adjustment buckle and attached at a first end of the first adjustment strap to a first end connector, the first end connector being adapted to attach to an article worn by a user, wherein the first adjustment strap is operatively connected to the first adjustment buckle so that the first adjustment buckle engages the first adjustment strap between the first end and a free end of the first adjustment strap, the free end of the first adjustment strap extends from the first adjustment buckle toward the first end connector to allow a person attached via the first end and connector to pull the free end of the first adjustment strap toward the first end connector and toward the person attached via the first end connector to draw the person toward the pole; and a second adjustment strap operatively attached to the outer strap via a second adjustment buckle and attached to a second end connector at a first end of the second adjustment strap, the second end connector being adapted to attach to an article worn by a user, wherein the second adjustment strap is operatively connected to the second adjustment buckle so that the second adjustment buckle engages the second adjustment strap between the first end and a free end of the second adjustment strap, the free end of the second adjustment strap extends from the second adjustment buckle toward the second end connector to allow a person attached via the second end and connector to pull the free end of the second adjustment strap toward the second end connector and toward a person attached via the second end connector to draw the person toward the pole.

2. The fall protection system of claim 1 wherein the outer strap connector is a cam buckle.

3. The fall protection system of claim 2 wherein the cross strap is connected to the outer strap connector via a releasable buckle.

4. The fall protection system of claim 3 wherein the releasable buckle comprises a male member releasably connectible to a female member.

5. The tall protection system of claim 4 wherein the releasable buckle is a stab-lock buckle.

6. The fall protection system of claim 1 further comprising a tensile member connected at a first end of the tensile member to the outer strap and connected at a second end of the tensile member to the sliding member.

7. The fall protection system of claim 6 wherein the tensile member comprises a coil spring.

8. The fall protection system of claim 7 wherein at least a portion of the coil spring passes through a sleeve attached to the outer strap.

9. The fall protection system of claim 8 wherein the sleeve has an opening extending along a length of the sleeve and closed by a releasable fastener to allow inspection of the coil spring.

10. The fall protection system of claim 9 wherein the releasable fastener comprises a zipper.

11. A fall protection system for use by a person in climbing a pole, comprising:

an outer strap;

an outer strap connector attached to the outer strap and adapted to adjust a length of the outer strap to extend around a pole;

a sliding member slidably positioned on the outer strap, a cross strap attached to the sliding member at one end of the cross strap, another end of the cross strap connected directly to a buckle, the buckle being fixed on the outer strap connector to prevent linear movement of the buckle relative to the outer strap connector along a length of the outer strap, a tensile member connected at a first end of the tensile member to the outer strap and connected at a second end of the tensile member to the sliding member, the tensile member extending only a portion of the length between the sliding member and the outer strap connector, a first adjustment strap operatively attached to the outer strap connector via a first adjustment buckle and attached at an end of the first adjustment strap to a first end connector, the first end connector being adapted to attach to an article worn by a user; and a second adjustment strap operatively attached to the outer strap via a second adjustment buckle and attached at an end of the second adjustment strap to a second end connector, the second end connector being adapted to attach to an article worn by a user.

12. The fall protection system of claim 11 wherein the outer strap connector is a cam buckle.

13. The fall protection system of claim 12 wherein the cross strap is connected to the outer strap connector via a releasable buckle.

14. The fall protection system of claim 13 wherein the releasable buckle comprises a male member releasably connectible to a female member.

15. The fall protection system of claim 14 wherein the releasable buckle is a stab-lock buckle.

16. The fall protection system of claim 11 wherein the tensile member comprises a coil spring.

17. The fall protection system of claim 16 wherein at least a portion of the coil spring passes through a sleeve attached to the outer strap.

18. The fall protection system of claim 17 wherein the sleeve has an opening extending along a length of the sleeve and closed by a releasable fastener to allow inspection of the coil spring.

19. The fall protection system of claim 18 wherein the releasable fastener comprises a zipper.

20. A fall protection system for use by a person in climbing a pole, comprising:

an outer strap;

an outer strap connector in operative connection with the outer strap and adapted to adjust a length of the outer strap to extend around a pole;

a sliding member slidably positioned on the outer strap, a cross strap attached at one end of the cross strap to the sliding member, the cross strap being directly connected to an adjustment buckle fixed on the outer strap connector to prevent linear movement of the buckle relative to the outer strap connector alone a length of the outer strap, the adjustment buckle configured to allow a person to pull a free end of the cross strap toward the person to tighten a closed loop formed by the outer strap and the cross strap around the pole, a first adjustment strap operatively attached to the outer strap connector via a first adjustment buckle and attached at an end of the first adjustment strap to a first end connector, the first end connector being adapted to attach to an article worn by a user; and a second adjustment strap operatively attached to the outer strap via a second adjustment buckle and attached at an end of the second adjustment strap to a second end connector, the second end connector being adapted to attach to an article worn by a user.

21. A fall protection system for use by a person in climbing a pole, comprising:

an outer strap;

an outer strap connector comprising a cam buckle adapted to adjust the length of the outer strap in operative connection with the outer strap;

a sliding member slidably positioned on the outer strap, a cross strap attached at one end of the cross strap to the sliding member, the cross strap being in operative connection with the outer strap connector at another end of the cross strap, a tensile member connected at a first end of the tensile member to the outer strap and connected at a second end of the tensile member to the sliding member, a first adjustment strap attached to the cam buckle via a first adjustment buckle and attached at an end of the first adjustment strap to a first end connector, the first end connector being adapted to attach to an article worn by a user, the first adjustment buckle fixed directly on the cam buckle with no portion of the outer strap connecting the cam buckle with the first adjustment buckle; and a second adjustment strap operatively attached to the outer strap via a second adjustment buckle and attached at an end of the second adjustment strap to a second end connector, the second end connector being adapted to attach to an article worn by a user.

22. The fall protection system of claim 21 wherein the cross strap is connected to the cam buckle via a releasable buckle.

23. The fall protection system of claim 22 wherein the releasable buckle comprises a male member releasably connectible to a female member.

24. The fall protection system of claim 23 wherein the releasable buckle is a stab-lock buckle.

25. The fall protection system of claim 22 wherein the releasable buckle is attached to a base member of the cam buckle.

26. The fall protection system of claim 25 wherein the first adjustment buckle is attached to a base member of the cam buckle.

27. The fall protection system of claim 21 wherein the tensile member comprises a coil spring.

28. The fall protection system of claim 22 wherein at least a portion of the coil spring passes through a sleeve attached to the outer strap.

29. The fall protection system of aim 23 wherein the sleeve is openable to allow inspection of the coil spring.

30. The fall protection system of claim 22 further comprising an adjustment buckle attached to the releasable buckle to adjust a length of the cross strap extending between the sliding member and the releasable buckle.

31. A fall protection system for use by a person in climbing a pole, comprising:

an outer strap;

a cross strap in operative connection with the outer strap at each end of the cross strap, a first adjustment strap operatively attached to the outer strap via a first adjustment buckle and attached at a first end of the first adjustment strap to a first end connector, the first end connector being adapted to attach to an article worn by a user, wherein the first adjustment strap is operatively connected to the first adjustment buckle so that the first adjustment buckle engages the first adjustment strap between the first end and a free end of the first adjustment strap, the free end of the first adjustment strap extends from the first adjustment buckle toward the first end connector to allow a person attached via the first end and connector to pull the free end of the first adjustment strap toward the first end connector and toward the person attached via the first end connector to draw the person toward the pole; and a second adjustment strap operatively attached to the outer strap via a second adjustment buckle and attached to a second end connector at a first end of the second adjustment strap, the second end connector being adapted to attach to an article worn by a user, wherein the second adjustment strap is operatively connected to the second adjustment buckle so that the second adjustment buckle engages the second adjustment strap between the first end and a free end of the second adjustment strap, the free end of the second adjustment strap extends from the second adjustment buckle toward the second end connector to allow a person attached via the second end and connector to pull the free end of the second adjustment strap toward the second end connector and toward the person attached via the second end connector to draw the person toward the pole.

* * * * *